US010122131B2

(12) United States Patent
Stevens et al.

(10) Patent No.: US 10,122,131 B2
(45) Date of Patent: Nov. 6, 2018

(54) DEVICE AND METHOD FOR PROTECTING SPRING-BIASED CONDUCTOR ELEMENTS

(71) Applicant: John Mezzalingua Associates, LLC, Liverpool, NY (US)

(72) Inventors: Brandon M. Stevens, North Syracuse, NY (US); Werner Wild, Buttenwiessen (DE)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 0 days.

(21) Appl. No.: 15/153,835

(22) Filed: May 13, 2016

(65) Prior Publication Data

US 2016/0336676 A1 Nov. 17, 2016

Related U.S. Application Data

(60) Provisional application No. 62/162,029, filed on May 15, 2015.

(51) Int. Cl.
*H01R 13/44* (2006.01)
*H01R 24/40* (2011.01)
*H01R 13/6583* (2011.01)

(52) U.S. Cl.
CPC ..... *H01R 24/40* (2013.01); *H01R 13/6583* (2013.01); *H01R 2201/02* (2013.01)

(58) Field of Classification Search
CPC ..... H01R 13/44
USPC ..... 439/578, 675, 140, 141
See application file for complete search history.

(56) References Cited

U.S. PATENT DOCUMENTS 3,206,540 A * 9/1965 Cohen ..... H01R 9/0521 174/75 C
3,275,970 A * 9/1966 Johanson ..... H01R 24/40 439/263
3,340,495 A * 9/1967 Weinschel ..... H01P 1/045 439/578
4,012,105 A * 3/1977 Biddle ..... H01R 24/40 439/581
4,431,255 A * 2/1984 Banning ..... H01R 9/0521 439/578
4,619,496 A * 10/1986 Forney, Jr. ..... H01R 24/40 439/434
4,708,666 A * 11/1987 Fisher, Jr. ..... H01R 24/40 439/515
4,875,866 A * 10/1989 Winant ..... H01R 33/22 439/140
5,021,011 A * 6/1991 Kawanami ..... H01R 24/40 439/582

(Continued)

*Primary Examiner* — Neil Abrams
(74) *Attorney, Agent, or Firm* — Barclay Damon LLP

(57) ABSTRACT

A connector including first and second connector portions each comprising electrically-connecting inner and outer conductors and an inhibitor interposing the inner and outer conductors configured to inhibit the inadvertent insertion of a non-mating connector between the inner and outer conductors. In one embodiment an insert is disposed over a plurality of spring-biased fingers of the outer conductor to prevent deformation of the fingers in an unassembled condition/state by insertion of the non-mating connector. In another embodiment, the insert includes a plurality of radial members disposed between a central hub and an outer ring to prevent insertion of the non-mating connector.

26 Claims, 6 Drawing Sheets

(56) References Cited

U.S. PATENT DOCUMENTS

| | | | | | |
|---|---|---|---|---|---|
| 5,456,611 | A * | 10/1995 | Henry | H01R 13/6395 | 439/180 |
| 5,514,001 | A * | 5/1996 | Szegda | H01R 13/193 | 439/259 |
| 5,704,809 | A * | 1/1998 | Davis | H01R 13/434 | 439/349 |
| 5,807,117 | A * | 9/1998 | Kempf | H01R 13/18 | 439/63 |
| 5,823,806 | A * | 10/1998 | Nagase | H01R 13/44 | 439/140 |
| 7,025,630 | B2 * | 4/2006 | Laverick | H01R 9/0518 | 439/578 |
| 7,347,727 | B2 * | 3/2008 | Wlos | H01R 13/6277 | 439/578 |
| 7,922,528 | B2 * | 4/2011 | Jackson | H01R 24/44 | 439/578 |
| 8,827,743 | B1 * | 9/2014 | Maury | H01R 13/6275 | 439/578 |
| 9,905,956 | B2 * | 2/2018 | Feldchtein | H01R 13/44 | |
| 9,966,702 | B2 * | 5/2018 | Swearingen | H01R 13/642 | |
| 2016/0336676 | A1 * | 11/2016 | Stevens | H01R 13/6583 | |

* cited by examiner

DEVICE AND METHOD FOR PROTECTING SPRING-BIASED CONDUCTOR ELEMENTS

CROSS-REFERENCE TO RELATED APPLICATIONS

This application is a non-provisional patent application of, and claims the benefit and priority of, U.S. Provisional Patent Application No. 62/162,029 filed on May 15, 2015. The entire contents of such application is hereby incorporated by reference.

BACKGROUND

Telecommunications systems often employ hardline connectors for data transfer between telecom components, e.g., a Remote Radio Unit (RRU) and a telecommunications sector antenna. These hardline connectors often employ an arrangement of spring-biased fingers/elements for making the requisite electrical connections, e.g., signal or electrical ground connections, from one connector to an opposing connector. One type of connector, known as a Mini-Din Connector, employs a multi-fingered inner conductor socket surrounded by a multi-fingered outer connector basket which receive an inner conductor pin and an outer conductor sleeve, respectively, of an adjoining/opposing connector.

The geometric similarity between connectors, in combination with the difficulty associated with physically making a connection, i.e., fifty (50) feet in the air, can cause Linemen to improperly/incorrectly join connectors. While improperly-mated connectors will not affect a viable telecommunications connection, an attempt to join the connectors can damage or, otherwise distort, at least one of the conductors. Particularly vulnerable are the fingers of the outer conductor basket. That is, should connectors be forcibly joined, the outer conductor sleeve of one connector can plastically deform the outer conductor basket of the Mini-Din connector. Inasmuch as the connector is often an integral component of an electronic component, i.e., the Remote Radio Unit, a seemingly small amount of damage to the integral connector can incapacitate a very costly piece of telecommunications equipment, e.g., ranging from 20K to 40K dollars, to replace.

Therefore, there is a need to overcome, or otherwise lessen the effects of, the disadvantages and shortcomings described above.

BRIEF DESCRIPTION OF THE DRAWINGS

Additional features and advantages of the present disclosure are described in, and will be apparent from, the following Brief Description of the Drawings and Detailed Description.

SUMMARY OF THE INVENTION

A connector is provided including first and second connector portions each comprising electrically-connecting inner and outer conductors. A insert interposes the spring-biased fingers of an outer conductor basket of one of the connectors to prevent damage to the fingers in an unassembled condition/state, thereby ensuring electrical connectivity of the fingers in an assembled condition/state. In one embodiment, a collapsible protective insert includes an insert ring disposed around the spring-biased fingers and a plurality of spiral springs projecting axially from one side of the insert ring. In an unassembled condition/state, the spiral springs maintain the position of the insert ring relative to the spring-biased fingers to mitigate plastic deformation of the fingers in a radially outboard direction. In an assembled condition/state, the spiral springs nest with the insert ring in response to a compressive load applied to the other side of the insert ring as the first and second connector portions are coupled.

In another embodiment, a static insert comprises a plurality of radial members projecting from an inner ring disposed around an inner conductor of the first connector. In this embodiment, a radial gap is produced between an outer peripheral edge of the radial members and the compliant fingers of the first connector. In an unassembled condition/state, the static insert prevents ingress of an improperly-sized outer conductor sleeve. In an assembled condition, a cylindrical sleeve of the second connector slides into the radial gap to make electrical contact with the spring-biased fingers of the first connector.

DETAILED DESCRIPTION

The following describes a Mini-DIN connector and a protective insert for mitigating damage to the multi-fingered spring-biased outer conductor basket of the Mini-DIN connector. While the insert is particularly useful for Mini-DIN connectors, it should be appreciated that the protective insert, and the teachings associate therewith are applicable to a wide-variety of telecommunications/signal connectors.

The protective insert 20 of the present disclosure has utility when the Mini-DIN Connector is unassembled, or is being prepared for assembly. Specifically, the insert 20 prevents damage to a Mini-DIN connector, i.e., one half of the connector, in the event that a connector of a different size or variety is forcibly urged into engagement with the Mini-DIN connector. As such, a costly error may be obviated through the use of the protective insert.

Figure 1:
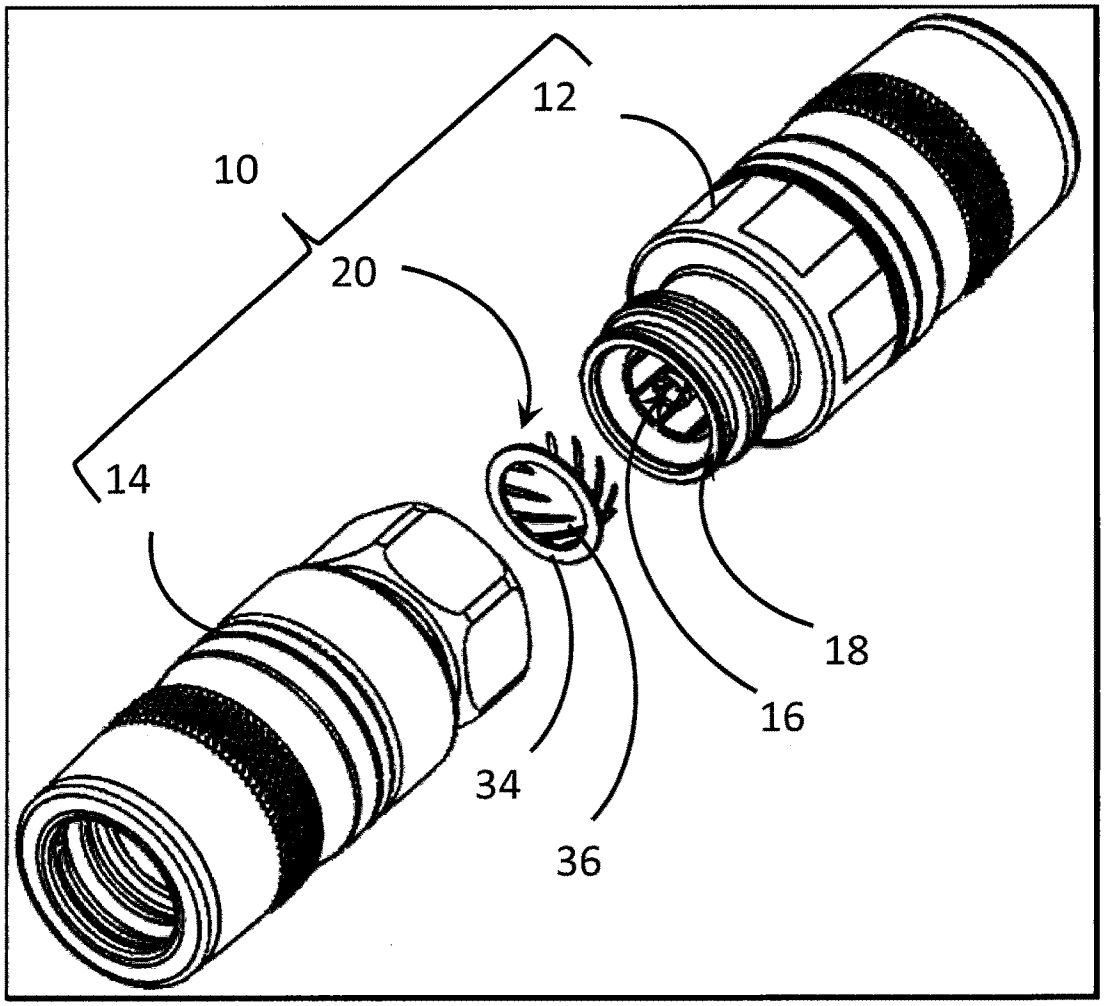
FIG. 1 is an exploded view of Mini-Din 4.3-10 connector comprising (i) a first connector portion comprising a multi-fingered inner conductor socket surrounded by multi-fingered outer conductor basket, (ii) a second connector portion comprising an inner conductor pin surrounded by a cylindrical sleeve, and (iii) a collapsible protective insert disposed over the outer conductor basket inhibiting plastic deformation of the basket fingers to protect and support the outer conductor basket should a connector be improperly insert into the basket.
Figure 2:
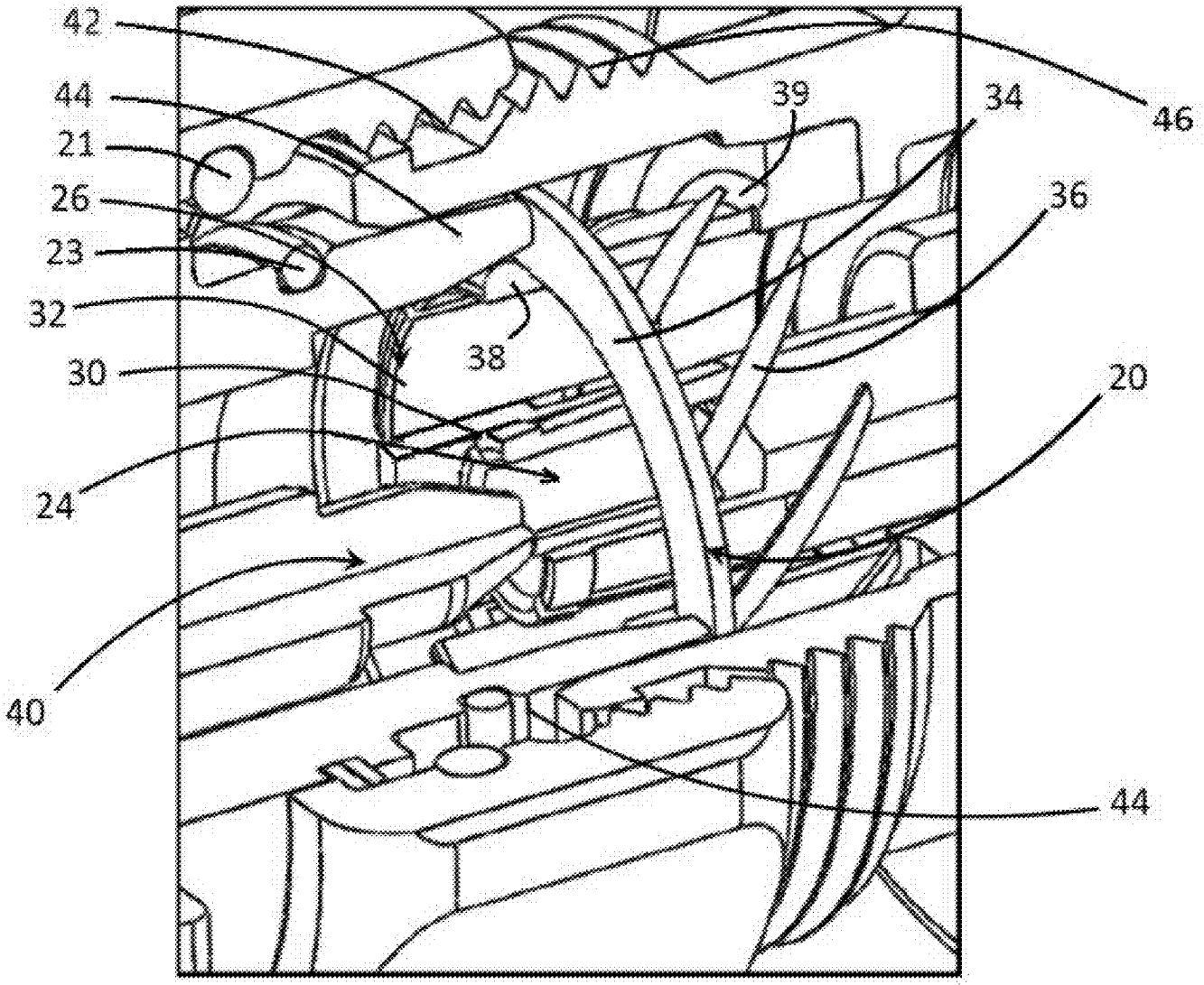
FIG. 2 is an enlarged, partially broken away and sectioned view of the Mini-Din connector in an unassembled condition wherein an upper retention ring of the collapsible protective insert surrounds, protects, and supports the spring-biased fingers of the outer conductor basket.

In FIGS. 1 and 2, a connector 10 is depicted including first and second connectors 12 and 14 each having an inner conductor 16 and an outer conductor 18. An insert 20 is disposed in combination with the internal conductor 16 to protect the conductor 16 in an unassembled condition/state to ensure the connectivity of the conductor 16 with an opposing conductor (not seen in the perspective view shown) in an assembled condition/state. In the described embodiment and referring to FIG. 2, the connector is a mini-DIN connector 10 having a multi-fingered inner conductor socket 24 and a multi-fingered outer conductor basket 26. A mini-DIN connector of the type described may have an impedance of about fifty Ohms (50Ω) with a frequency range of between about one Kilo-Hertz (0.1 GHz) to about six Giga-Hertz (6 GHz.) Such mini-DIN connectors are available for purchase under the model designations 4.1/9.5 mini-DIN from JMA Wireless Inc., located in Liverpool, state of New York.

The individual fingers 30 of the inner conductor socket 24 are spring-biased inwardly such that the fingers 30 of the socket 24 may collectively capture or frictionally engage an inner conductor pin 40 of the second connector 14. The individual fingers 32 of the outer conductor basket 26 are spring-biased outwardly such that the fingers 32 of the basket 26 may collectively capture or frictionally engage an outer conductor sleeve 44 of the second connector 14. The outer conductor sleeve 44 defines an annular opening or space between the female threads 42 of the second connector 14 and the radially outboard peripheral surface of the outer conductor sleeve 44. The annular opening receives and accommodates the male threads 46 of the outer conductor 18. More specifically, the male-threaded outer conductor 18 of the first connector 12 threadably axially engages the female-threaded outer conductor sleeve 45 of the second connector 14. As the male-threaded outer conductor 18 of the first connector 12 engages the female-threaded outer conductor sleeve 45 of the second connector 14, the connectors are sealed from moisture/FOD by inner and outer O-rings 21, 23. The inner O-ring 21 seals the mating interface between the radially outboard peripheral surface of the first conductor 18 while the outer O-ring 23 seals the mating interface between the radial inboard peripheral surface of the second connector 14.

Figure 3:
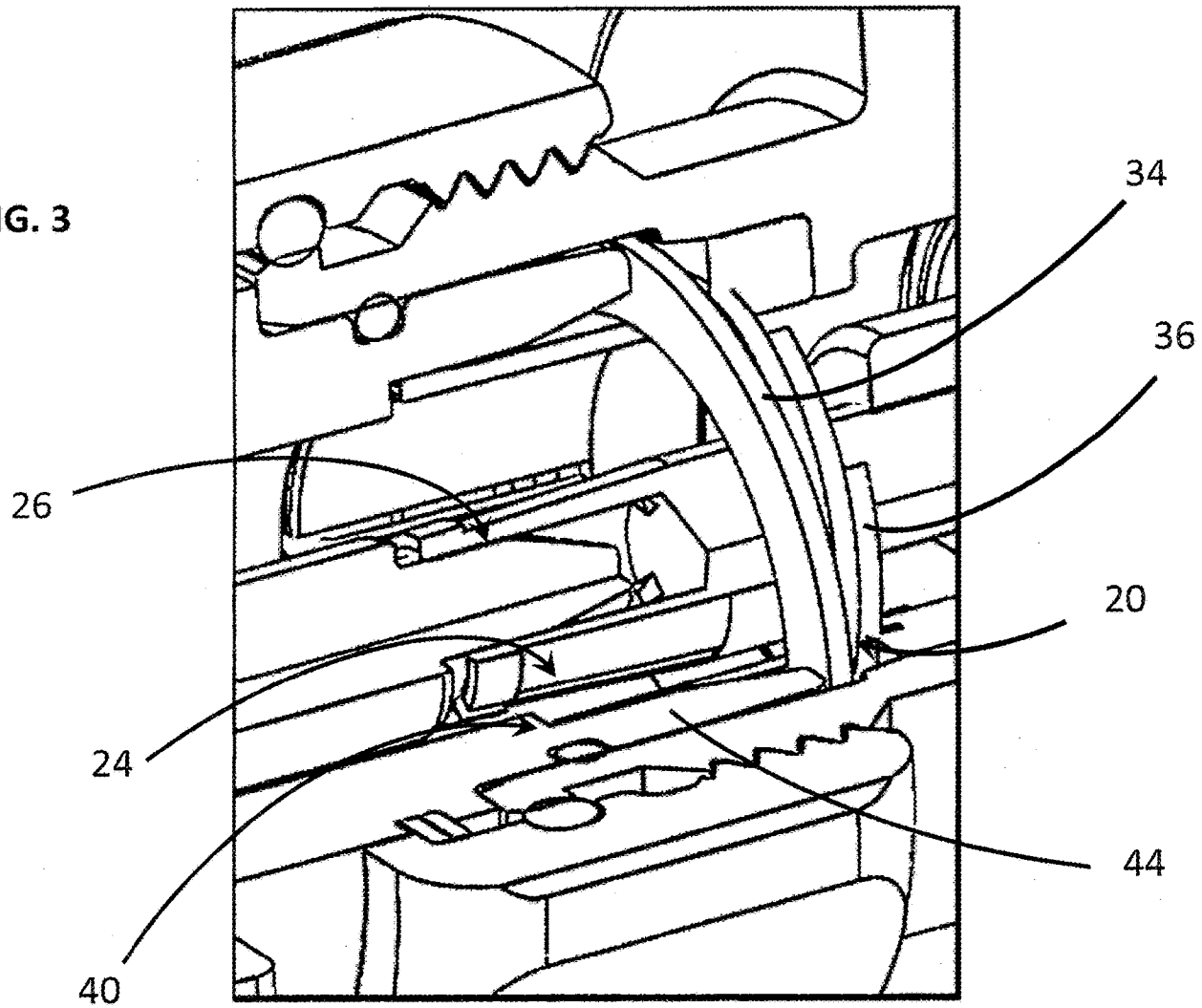
FIG. 3 is an enlarged, partially broken away and sectioned view of the Mini-Din connector in a fully-assembled condition wherein the ring portion of the protective insert collapses downwardly or inwardly to allow the outer conductor basket fingers of the first connector portion to engage the outer conductor sleeve of the second connector portion.

In FIGS. 2 and 3, the insert 20 comprises a collapsible protective insert 20 having an insert ring 34 and a plurality of spiral spring fingers 36 projecting to one side of the insert ring 34. In the described embodiment, the protective insert 20 is fabricated from a non-conductive (i.e., low-dielectric), low modulus, plastic, thermoplastic, or phenolic material which may be injection or blow molded. The spiral spring fingers 36 are integrally formed with the insert ring 34 such that the spiral springs 36 project at an angle relative to a geometric plane defined by the insert ring 34. Specifically, each spiral spring defines an angle within a range of between about five degrees (5°) to about forty-five degrees (45°).

In an unassembled condition/state, shown in FIG. 2, the spiral spring fingers 36 maintain the position and planar orientation of the insert ring 34 relative to the fingers 36 of the outer conductor basket 18. The insert ring 34 may be positioned to circumscribe the outwardly biased fingers 36 proximal to the tip end of each spring-biased finger 36, or positioned immediately below the shouldered lip 38 of each spring-biased finger 36. In one embodiment, the diameter of the insert ring 34 is less than the diameter collectively defined by the lips 38 of the spring-biased fingers 36. As such, the protective insert 20 is axially retained by the fingers 36 inasmuch as the geometry of the insert ring 34, i.e., the diameter of the insert ring 34 vs. the radius of the spring fingers 36, inhibits axial displacement in one direction, i.e., in an outward direction, past the shouldered lip 38 of each spring-biased finger 36. Furthermore, the free-end of each spring-biased finger 36 may engage the annular base 39 of the outer conductor basket 18 to urge the insert ring 34 against the shouldered lip 38. As such, the spring-biased fingers 36 produce a preload to prevent the protective insert from becoming dislodged from the first connector 12. This configuration also facilitates assembly, and shipping/handling of the connector inasmuch as the protective insert 20 may be snapped into position, i.e., trapped by the shouldered lip 38 and the annular base 39, in advance of shipping.

In the unassembled condition or state, an improperly-mated connector may forcibly urge the spring-biased fingers 36 in a radially outboard direction. The insert ring 34 limits the motion of the spring-biased fingers 36 such that the displacement remains within the elastic range of the material properties, i.e., the material used to fabricate the spring-fingers 36. In an assembled condition, the spiral springs 36 nest with the insert ring 34 in response to a compressive load applied to the other side of the ring 34 as the first and second connectors 12, 14 are coupled. As such, the shouldered lip 38 of each spring-biased finger 36 may electrically and mechanically couple the first and second connectors 12, 14.

Figure 4:
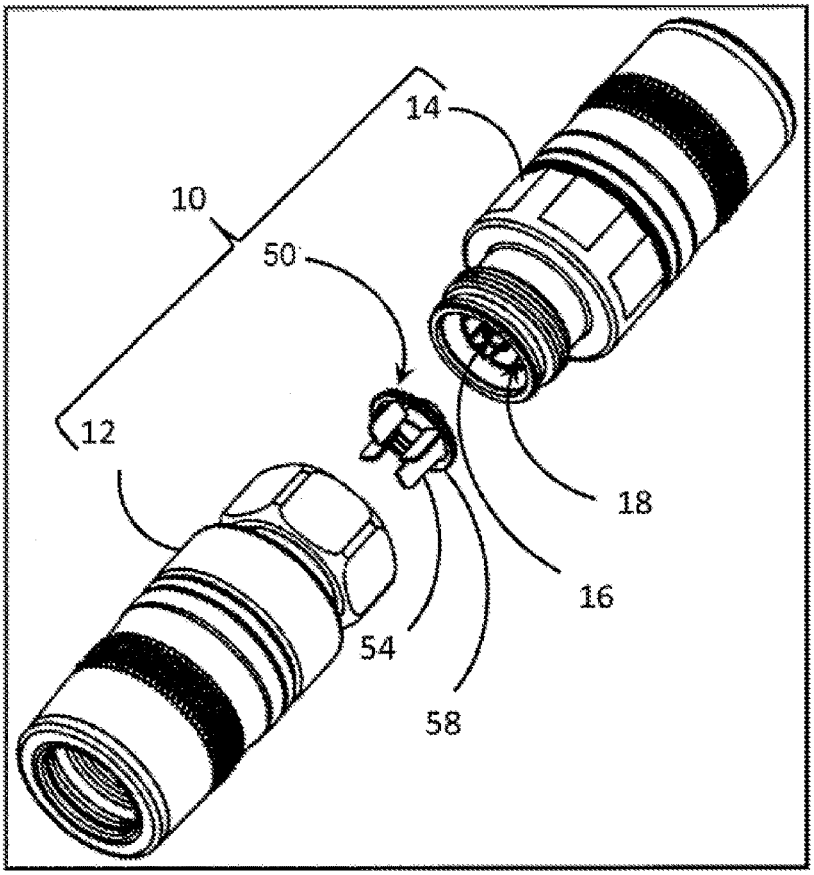
FIG. 4 is an exploded view of another embodiment of the Mini-Din 4.3-10 connector wherein a static insert is disposed over the inner conductor socket and into the outer conductor basket to block the ingress of an improperly-sized connector and the potential for damage to the basket fingers.
Figure 5:
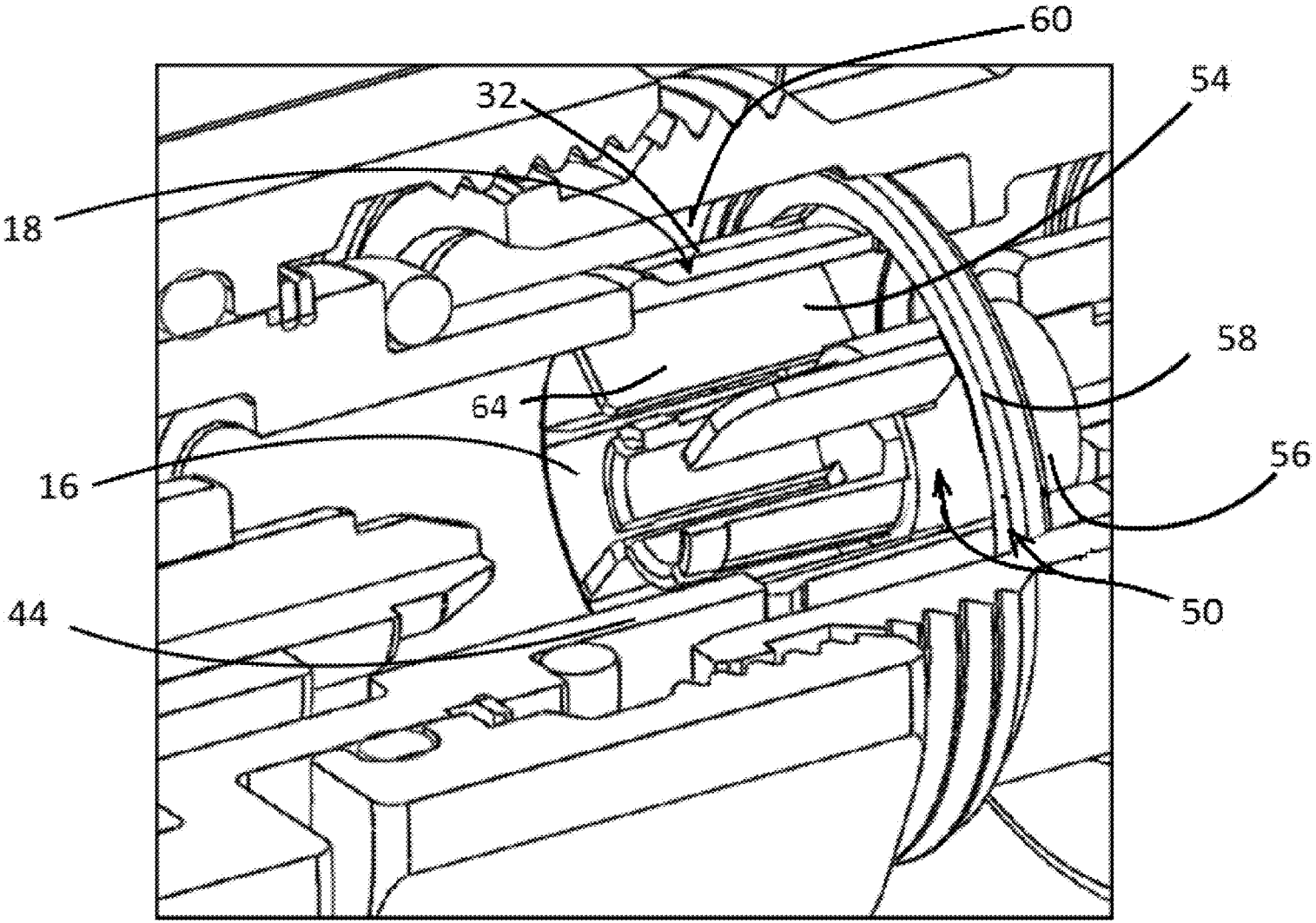
FIG. 5 is an enlarged, partially broken away and sectioned view of the Mini-Din connector in an unassembled condition wherein radial supports members project from an inner ring surrounding the inner conductor socket to the outer conductor basket fingers, the radial support members blocking the entrance of an improperly-sized outer conductor sleeve.
Figure 6:
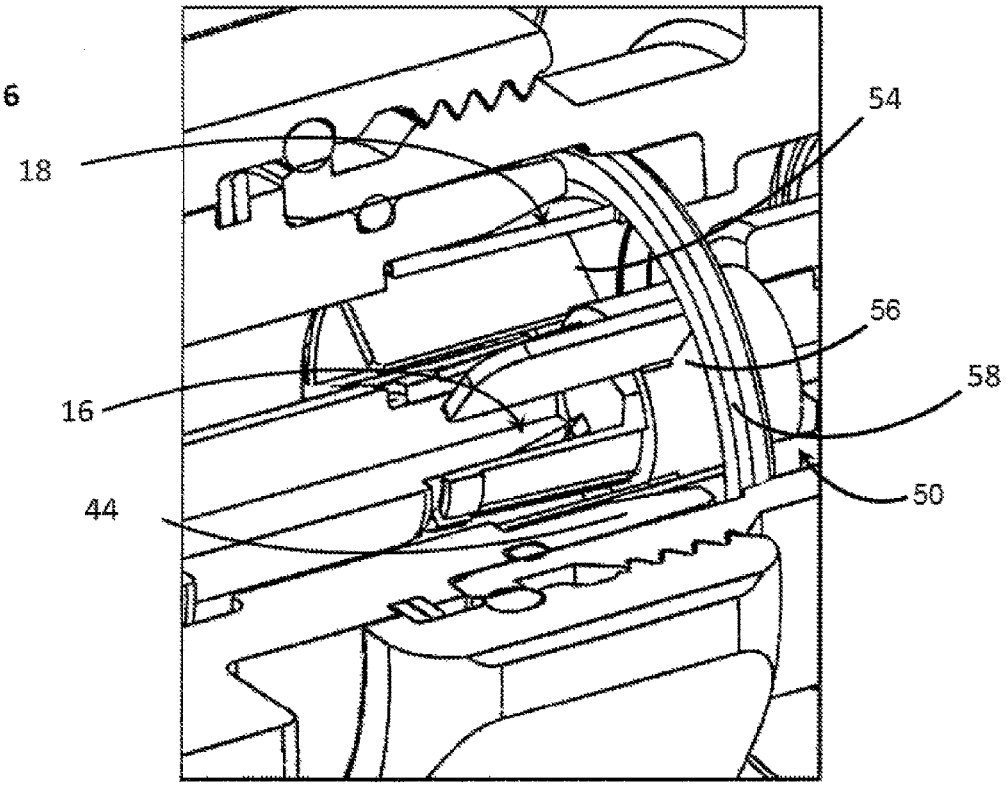
FIG. 6 is an enlarged, partially broken away and sectioned view of the Mini-Din connector in a fully-assembled condition wherein an outer conductor sleeve of the first connector portion slides axially past and along the outer peripheral edge of the radial support members to connect the first and second portions of the Mini-Din connector.

In FIGS. 4-6, another embodiment of the connector 10 is illustrated wherein a motion-inhibiting static insert or stop 50 is disposed between the inner and outer conductors 16, 18 of the first and second connectors 12, 14. The static insert 50 includes: (i) a central hub 56 disposed about the inner conductor 16 of the first connector 12, (ii) a plurality of radial members 54 projecting from the central hub 56, and (iii) an outer ring 58 disposed within a radial gap 60 (see FIG. 5) between the outwardly biased spring fingers 32 of the inner conductor basket 18 and the male-threaded outer conductor portion of the first connector 12. In this embodiment, the static insert 50 includes four (4) radial members 54, however, the insert 50 may include as few as two (2) and as many as six (6) radial members 54. Generally, the number should prevent a mismatched or improper connector (not shown) from inadvertently being insert in the radial area 64 between the hub 56 and the outer conductor basket 18. Accordingly, at least one radial member 54 projects from the hub 56 and has a radial dimension which is selectively sized to prevent at least partial insertion of a non-mating connector into a first connector portion.

As mentioned in the preceding paragraph, in an unassembled condition/state, the protective insert 50 prevents ingress of an improperly-sized outer conductor sleeve (not shown). That is, by inhibiting the inadvertent insertion of an improperly-sized outer conductor, the outwardly projecting spring fingers 32 cannot be plastically deformed in direction causing permanent connector damage. In an assembled condition, a cylindrical sleeve 44 of the second connector 14 slides into the radial gap 60 between the outwardly biased spring fingers 30 and the outer conductor sleeve to make electrical and mechanical contact with the spring-biased fingers 18 of the first connector 12.

The insert 50 inhibits insertion within the radial space 64 such that damage to the spring-biased fingers 18 cannot occur. The insert 50 can remain in place until the spring-biased fingers 18 can no longer properly engage or reliably capture the second connector 14.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A connector comprising:

first and second connector portions each having an electrically connecting inner conductor and an electrically connecting outer conductor, one of the connector portions having an inner conductor socket and an outer conductor basket; and an insert, disposed between the inner conductor socket and the outer conductor basket of the first and second connector portions, the inner conductor socket and outer conductor basket each having a plurality of axially projecting fingers wherein adjacent fingers of the socket and basket are separated by an axial slot, the insert configured to:

(i) engage at least one of the axially projecting fingers of the outer conductor basket to prevent plastic deformation of a spring-biased finger upon attempting to mate improperly sized connectors; and (ii) disengage the at least one axially projecting fingers upon assembly of properly mated connectors.

2. The connector of claim 1 wherein the insert includes an insert ring configured to circumscribe the outwardly-biased spring fingers, the insert ring inhibiting the plastic deformation of the outwardly-biased spring fingers in the unassembled condition.

3. The connector of claim 1 wherein the basket fingers are outwardly biased, and wherein the insert includes a hub configured to circumscribe the conductive socket, an insert ring configured to circumscribe the outwardly-biased basket fingers and at least one radial member projecting from the hub and having a radial dimension selectively sized to prevent at least partial insertion of one connector portion into another connector portion.

4. The connector of claim 2 wherein the insert ring includes a plurality of spiral springs projecting from a side of the insert ring, the spiral springs configured to collapse and nest in combination with each other and with the insert ring when the first and second connectors engage in an assembled condition.

5. The connector of claim 4 wherein the each of the spiral springs define an angle within a range of between about five about degrees (5°) to about forty-five degrees (45°).

6. The connector of claim 3 wherein insert includes a plurality of radial members disposed in the radial area between the inner conductor and the outwardly biased conductor of the outer conductor.

7. The connector of claim 4 wherein the each of the spiral springs is formed from a low dielectric material.

8. The connector of claim 4 wherein each of the spiral springs is formed from the group of: a thermoplastic, thermoset, polyamid, and phenolic materials.

9. The connector of claim 3 wherein the each of the radial members is formed from a low dielectric material.

10. The connector of claim 3 wherein the radial members are formed from the group of: a thermoplastic, thermoset, polyamide, and phenolic materials.

11. The connector of claim 1 wherein the connector includes first and second connector portions each having inner and outer conductors, the outer conductor of at least one of the connector portions comprising a plurality of spring-biased fingers, wherein the insert comprises an insert ring and a plurality of spiral springs projecting axially from one side of the insert ring, the spiral springs nesting with each other and against the insert ring in response to an axial displacement applied to a side of the insert ring; and wherein, in an unassembled condition, the insert ring is disposed around the spring-biased fingers to mitigate plastic deformation of the spring-biased fingers in a radially outboard direction, and wherein, in an assembled condition, the insert collapses such that the spiral springs nest with the insert ring as the insert ring is forced downwardly by the outer conductor sleeve of the second connector portion as the first and second connector portions are coupled.

12. The connector of claim 11 wherein one of the conductors includes a connector basket having a plurality of outwardly biased spring fingers, each spring finger having a shouldered lip, the shouldered lips collectively defining a first diameter dimension, and wherein the insert ring circumscribes the spring fingers and a defines second diameter dimension, the first diameter dimension of the shouldered lips being greater than the second diameter dimension of the insert ring.

13. The connector of claim 1 wherein the connector includes first and second connector portions each having inner and outer conductors, the outer conductor of at least one of the connector portions comprising a plurality of spring-biased fingers, wherein the insert includes a plurality of radial members projecting from an inner ring disposed around the inner conductor of one of the connector portions, the radial members defining a radial gap between an outer peripheral edge of the radial members and the outer conductor of the respective connector portion;

wherein, in an unassembled condition, the insert prevents ingress of an improperly-sized outer conductor sleeve, and wherein, in an assembled condition, a cylindrical sleeve of the other connector portion slides into the radial gap defined between the radial members and the compliant fingers of the respective connector portion to make electrical contact between the outer conductors of the first and second connectors.

14. The connector of claim 13 wherein insert includes a hub disposed over an inner conductor;

a ring disposed within a radial gap defined by and between the outwardly biased spring members and the inner conductor basket, and a plurality of radial members disposed in the radial area between the inner conductor and the outwardly biased conductor of the outer conductor.

15. The connector of claim 13 wherein the insert includes between two (2) and six (6) radial members.

16. The connector of claim 13 wherein the hub, ring and plurality of radial members are integrally molded.

17. The connector of claim 16 wherein the radial members are formed from a low dielectric material.

18. The connector of claim 17 wherein the radial members is formed from the group of: a thermoplastic, thermoset, polyamide, and phenolic materials.

19. In a connector having first and second connector portions operative to transmit RF signals across an interface of the connector, at least one of the connector portions, comprising:

an inner conductor socket for transmitting the RF signals from one connector portion to the other connector portion;

an outer conductor operative to electrically ground the respective one of the connector portions;

the conductor socket and the conductor basket each having a plurality of axially projecting fingers wherein adjacent fingers of the socket and basket are separated by an axial slot; and an inhibitor interposing the inner conductor socket and the outer conductor basket and comprising an insert configured to:

(i) engage at least one of the axially projecting fingers of the outer conductor basket to prevent plastic deformation of a spring-biased finger upon attempting to mate improperly sized connectors; and (ii) disengage the at least one axially projecting fingers upon assembly of properly mated connectors.

20. The connector of claim 19 wherein the insert includes an insert ring configured to engage a base portion of the axially projecting.

21. The connector of claim 20 wherein the insert ring includes a plurality of spiral springs projecting from a side of the insert ring, the spiral springs configured to collapse and nest in combination with each other and with the insert ring when mating connectors engage in an assembled condition.

22. The connector of claim 19 wherein the insert includes a plurality of radial members projecting from a hub member disposed around the inner conductor, the radial members defining a radial gap between an outer peripheral edge of the radial members and the outer conductor of the conductive basket.

23. The connector of claim 22 further comprising an insert ring configured to circumscribe the axially projecting fingers, wherein the radial members project from the hub member to the insert ring and have a radial dimension selectively sized to prevent misalignment of the first and second cable connector portions.

24. The connector of claim 19 wherein the inhibitor includes a low dielectric material.

25. The connector of claim 19 wherein the low dielectric material is formed from the group of: a thermoplastic, thermoset, polyamide, and phenolic materials.

26. A first cable connector portion configured to electrically transmit RF signals from the first cable connector portion to a second cable connector portion across a mating interface, comprising:

an inner conductor socket transmitting the RF signals across the mating interface;

an outer conductor basket operative to electrically ground the cable connector portion;

the inner conductor socket and the outer conductor basket each having a plurality of axially projecting fingers, wherein adjacent fingers thereof are separated by an axial slot; and, an insert interposing the inner conductor socket and the outer conductor basket; the insert configured to:

(i) engage at least one of the axially projecting fingers of the outer conductor basket to prevent plastic deformation of a spring-biased finger upon attempting to mate improperly sized connectors; and (ii) disengage the at least one axially projecting fingers upon assembly of properly-mated connectors (i) engage an inwardly disposed surface of at least one of the axially projecting fingers of the outer conductor basket to prevent plastic deformation thereof in a radially outboard direction;

(ii) disengage the inwardly disposed surface of the at least one axially projecting finger upon assembly properly-mated connector portions; and (iii) prevent the insertion of a non-mating second connector portion into the space between the inner conductor socket and the outer conductor basket to prevent plastic deformation of at least one of the axially projecting fingers in a radially inboard direction by the non-mating second connector portion.

* * * * *